US005429761A

United States Patent [19]

Havelka et al.

[11] Patent Number: 5,429,761

[45] Date of Patent: Jul. 4, 1995

[54] CARBONATED ELECTRORHEOLOGICAL PARTICLES

[75] Inventors: Kathleen O. Havelka, Mentor; Edward A. Collins, Avon Lake, both of Ohio

[73] Assignee: The Lubrizol Corporation, Wickliffe, Ohio

[21] Appl. No.: 227,814

[22] Filed: Apr. 14, 1994

[51] Int. Cl.[6] ..... C10M 171/00; C09K 3/00

[52] U.S. Cl. ..... 252/74; 252/73/572

[58] Field of Search ..... 252/73, 74, 572

[56] References Cited

U.S. PATENT DOCUMENTS

| | | | |
|---|---|---|---|
| 3,047,507 | 7/1962 | Winslow | 252/75 |
| 3,970,573 | 7/1976 | Westhaver | 252/73 |
| 3,989,872 | 11/1976 | Ball | 428/40 |
| 4,452,830 | 6/1984 | Yoshizumi | 427/215 |
| 4,937,060 | 6/1990 | Kathirgamanathan et al. | 428/403 |
| 4,990,279 | 2/1991 | Ahmed | 252/73 |
| 5,032,308 | 7/1991 | Knobel et al. | 252/74 |
| 5,034,476 | 7/1991 | Saito et al. | 525/477 |
| 5,266,230 | 11/1993 | Tomizawa et al. | 252/73 |
| 5,336,423 | 8/1994 | Pialet et al. | 252/76 |

FOREIGN PATENT DOCUMENTS

| | | |
|---|---|---|
| 342041 | 11/1981 | European Pat. Off. . |
| 0394409 | 10/1990 | European Pat. Off. . |
| 409319 | 1/1991 | European Pat. Off. . |
| 509572 | 10/1992 | European Pat. Off. . |
| 562978 | 9/1993 | European Pat. Off. . |
| 63-97694 | 4/1988 | Japan . |
| 64-6093 | 1/1989 | Japan . |
| 393898 | 4/1991 | Japan . |
| 3119098 | 5/1991 | Japan . |
| 2230532 | 10/1990 | United Kingdom . |
| 9000583 | 1/1990 | WIPO . |

OTHER PUBLICATIONS

Gow, C. J. and Zukoski, C. F.; The Eletrorheological Properties of Polyaniline Suspensions, Aug. 1, 1989, pp .175–176.

*Primary Examiner*—Paul Lieberman
*Assistant Examiner*—Gregory R. Delcotto
*Attorney, Agent, or Firm*—David M. Shold; Frederick D. Hunter, Sr.

[57] ABSTRACT

Electrorheological fluids of a hydrophobic liquid phase and, dispersed therein, electrorheologically active particles comprising a core particle and a coating of a metal carbonate, sulfate, thiosulfate, or sulfite exhibit reduced electrical conductivity compared with similar fluids containing uncoated particles.

17 Claims, No Drawings

CARBONATED ELECTRORHEOLOGICAL PARTICLES

BACKGROUND OF THE INVENTION

The present invention relates to treated particles suitable for use in electrorheological fluids.

Electrorheological ("ER") fluids are fluids which can rapidly and reversibly vary their apparent viscosity in the presence of an applied electric field. ER fluids are generally dispersions of finely divided solids in hydrophobic, electrically non-conducting oils. They have the ability to change their flow characteristics, even to the point of becoming solid, when subjected to a sufficiently strong electrical field. When the field is removed, the fluids revert to their normal liquid state. ER fluids may be used in applications in which it is desired to control the transmission of forces by low electric power levels, for example, in clutches, hydraulic valves, shock absorbers, vibrators, or systems used for positioning and holding work pieces in position.

The prior art teaches the treatment of fine particles with surface coatings of various types in order to impart some particularly desired property to the particles. For example, U.S. Pat. No. 4,990,279, Ahmed, Feb. 5, 1991, discloses electrorheological fluids prepared from monomers which are polymerized in a low conductivity medium. The polymer particles are further modified through polymerization of a hydrophilic monomer to form a hydrophilic shell or globule around the particles, which constitutes a minor part of the particle.

U.S. Pat. No. 3,989,872, Ball, Nov. 2, 1976, discloses fine powders comprising yttira stabilized zirconia powders encased in a thin calcia shell, for plasma spray coating processes. The coating is accomplished by first forming a deposit of calcium carbonate on the individual particles and converting the calcium carbonate to calcium oxide by heating.

European publication 394,049, Oct. 24, 1990, discloses electrorheological fluids comprising a dispersed particulate phase which includes a plurality of composite particulate bodies, each having a core with an electrically conductive surface coated with a layer of electrically relatively non-conductive material, with the composite particulate body having a density substantially the same as the density of the carrier liquid.

PCT publication WO90/00583, Jan. 25, 1990, discloses an electroviscous fluid comprising electrically polarizable aggregate particles dispersed in a dielectric fluid. A substantial portion of the aggregate particles comprise a core and an electrically insulative shield. The shield can be e.g. a resin, a plastic foam, or a ceramic glaze.

Japanese publication 63-97694, Apr. 28, 1988, discloses an electroviscous fluid containing particles with a three-phase structure which comprises a core of an organic solid particle, a conductive thin-film layer formed on its surface, and an electric insulating thin-film layer formed thereon. Examples of insulating materials include polyvinyl chloride, polyamide, polyacrylonitrile, polyvinylidene fluoride, wax, asphalt, varnish, silica, alumina, rutile, barium titanate, and the like.

Japanese publication 64-6093, Jan. 10, 1989, discloses an electroviscous fluid comprising an oily medium and dielectric fine particles consisting of a conductive particle coated with an electric insulating film having 1 μm or less thickness, and containing no water substantially. Representatives of the insulating materials include organic synthetic polymers, organic natural polymers, inorganic compounds such as silica, alumina, aluminum hydroxide, barium titanate and the like.

Japanese publication 3-93898, Apr. 18, 1991, discloses an electroviscous fluid consisting of fine particles which have a conductive layer on their insulating surface, which layer is coated further with an insulating film. Materials for the outermost film include silica, titania, alumina, tantalum, and styrene and epoxy resins.

U.S. Pat. No. 4,937,060, Kathirgamanathan, Jun. 26, 1990, discloses an inorganic powdery or granular material which is coated with a coating of an inherently conductive polymeric material. Conductive calcium carbonate and conductive aluminum trihydrate, when compounded into a polymer such as poly(vinyl chloride), are taught to e.g. impart conductivity to the polymer.

SUMMARY OF THE INVENTION

The present invention provides an electrorheological fluid comprising a hydrophobic liquid phase and, dispersed therein, electrorheologically active particles comprising a core particle and a coating of a metal carbonate, sulfate, thiosulfate, or sulfite.

The invention further provides electrorheologically active particles comprising an organic polymeric core particle and a coating of a metal carbonate, sulfate, thiosulfate, or sulfite.

The invention also provides a method for treating electrorheologically active particles, comprising the steps of mixing the electrorheologically active particles and a metal oxide or hydroxide in a protic medium and supplying to the mixture carbon dioxide, sulfur dioxide, or sulfur trioxide in an amount sufficient to convert at least a portion of the metal oxide or hydroxide to the salt.

The invention further provides a clutch, valve, shock absorber, or damper containing an electrorheological fluid as previously described.

DETAILED DESCRIPTION OF THE INVENTION

The first component of the present electrorheological fluids is a hydrophobic liquid phase, which is a non-conducting, electrically insulating liquid or liquid mixture. Examples of insulating liquids include silicone oils, transformer oils, mineral oils, vegetable oils, aromatic oils, paraffin hydrocarbons, naphthalene hydrocarbons, olefin hydrocarbons, chlorinated paraffins, synthetic esters, hydrogenated olefin oligomers, and mixtures thereof. The choice of the hydrophobic liquid phase will depend largely on practical considerations including compatibility of the liquid with other components of the system, solubility of certain components therein, and the intended utility of the ER fluid. For example, if the ER fluid is to be in contact with elastomeric materials, the hydrophobic liquid phase should not contain oils or solvents which affect those materials. Similarly, the liquid phase should be selected to have suitable stability over the intended temperature range, which in the case of the present invention will extend to 120° C. or even higher. Furthermore, the fluid should have a suitably low viscosity in the absence of a field that sufficiently large amounts of the dispersed phase can be incorporated into the fluid. Suitable liquids include those which have a viscosity at room temperature of 1 to 300 or 500 centistokes, or preferably 2 to 20 or 50 centistokes.

Mixtures of two or more different non-conducting liquids can be used for the liquid phase. Mixtures can be selected to provide the desired viscosity, pour point, chemical and thermal stability, component solubility, etc.

Useful liquids generally have as many of the following properties as possible: (a) high boiling point and low freezing point; (b) low viscosity so that the ER fluid has a low no-field viscosity and so that greater proportions of the solid dispersed phase can be included in the fluid; (c) high electrical resistance and high dielectric breakdown potential, so that the fluid will draw little current and can be used over a wide range of applied electric field strengths; and (d) chemical and thermal ,stability, to prevent degradation on storage and service.

Silicon-based oils such as the polyalkyl-, polyaryl-, polyalkoxy-, or polyaryloxysiloxane oils and silicate oils comprise a particularly useful class of synthetic hydrophobic liquids. Examples of silicate oils include tetraethyl silicate, tetraisopropyl silicate, tetra-(2-ethylhexyl)silicate, tetra-(4-methyl-2-ethylhexyl)silicate, and tetra-(p-terbutylphenyl)silicate. The silicone or siloxane oils are useful particularly in ER fluids which are to be in contact with elastomers. The selection of other silicone-containing fluids will be apparent to those skilled in the art.

Among the suitable vegetable oils for use as the hydrophobic liquid phase are sunflower oils, including high oleic sunflower oil available under the name Trisun TM 80, rapeseed oil, and soybean oil. By way of example, one of the suitable esters is di-isodecyl azelate, available under the name Emery TM 2960. Another illustrative fluid is hydrogenated poly alpha olefin, available under the name Emery TM 3004. Examples of other suitable materials for the hydrophobic liquid phase are set forth in detail in PCT publication WO93/14180, published Jul. 22, 1993.

The electrorheological fluid of the present invention further comprises particles within the hydrophobic liquid phase. These electrorheologically active particles comprise a core particle and a coating. The core particle can be any particle which exhibits electrorheological activity. Many ER active solids are known, and any of these, as well as their equivalents, are considered to be suitable for use in the ER fluids of the present invention. In some cases the core particles can also be particles which may themselves be too conductive to exhibit useful, measurable electrorheological activity in the absence of a coating, such as certain metal-coated microspheres. The core particles are preferably conductive or semiconductive materials, and are especially preferably materials which are capable of exhibiting electrorheological activity when they are substantially anhydrous. The preferred core particles are polymeric materials, especially polyanilines.

One preferred class of ER active solids suitable for use as the core particles includes carbohydrate based particles and related materials such as starch, flour, monosaccharides, and preferably cellulosic materials. The term "cellulosic materials" includes cellulose as well as derivatives of cellulose such as microcrystalline cellulose. Microcrystalline cellulose is the insoluble residue obtained from the chemical decomposition of natural or regenerated cellulose. Crystallite zones appear in regenerated, mercerized, and alkalized celluloses, differing from those found in native cellulose. By applying a controlled chemical pretreatment to destroy molecular bonds holding these crystallites, followed by mechanical treatment to disperse the crystallites in aqueous phase, smooth colloidal microcrystalline cellulose gels with commercially important functional and rheological properties can be produced. Microcrystalline cellulose can be obtained from FMC Corp. under the name Lattice TM NT-013. Amorphous cellulose is also useful in the present invention; examples of amorphous cellulose particles are CF1, CF11, and CC31, available from Whatman Specialty Products Division of Whatman Paper Limited, and Solka-Floc TM, available from James River Corp. Other cellulose derivatives include ethers and esters of cellulose, including methyl cellulose, ethyl cellulose, hydroxyethyl cellulose, hydroxypropyl cellulose, sodium carboxymethyl cellulose, cellulose propionate, cellulose butyrate, cellulose valerate, and cellulose triacetate. Other cellulose derivatives include cellulose phosphates and cellulose reacted with various amine compounds. Other cellulosic materials include chitin, chitosan, chondrointon sulfate, and viscose or cellulose xanthate. A more detailed listing of suitable cellulosics is set forth in PCT publication WO93/14180.

In another embodiment, the ER active solid particles are particles of organic semiconductive polymers such as oxidized or pyrolyzed polyacrylonitrile, polyacene quinones, ones, polypyrroles, polyphenylenes, polyphenylene oxides, polyphenylene sulfides, polyacetylenes, polyvinylpyridines, polyvinylpyrrolidones, polyvinylidene halides, polyphenothiazines, polyimidazoles, and preferably polyaniline, substituted polyanilines, and aniline copolymers. Compositions of the above and related materials, treated or doped with various additives including acids, bases, metals, halogens, sulfur, sulfur halides, sulfur oxide, and hydrocarbyl halides can also be employed. A more detailed description of certain of these materials can be found in PCT publication WO93/07243, published Apr. 15, 1993. A preferred organic polymeric semiconductor is polyaniline, particularly the polyaniline prepared by polymerizing aniline in the presence of an oxidizing agent (such as a metal or ammonium persulfate) and 0.1 to 1.6 moles of an acid per mole of aniline, to forman acid salt of polyaniline. The polyaniline salt is thereafter treated with a base to remove some or substantially all of the protons derived from the acid. A more complete description of polyaniline and its preferred method of preparation is set forth in PCT publication WO93/07244, published Apr. 15, 1993. The aniline polymer can be the homopolymer or any of a number of copolymers or modified polymers such as a sulfonated aniline/o-toluidine copolymer.

Inorganic materials which can be suitably used as ER active particles include carbonaceous powders, metals, semiconductors (based on silicon, germanium, and so on), barium titanate, silver germanium sulfide, ceramics, copper sulfide, carbon particles, silica gel, magnesium silicate, alumina, silica-alumina, pyrogenic silica, zeolites, and the like. These can be in the form of solid particles or, in certain cases, hollow microspheres, the latter being available from, i.a., PQ Corporation of Valley Forge, Pa. Microspheres include hollow ceramic microspheres, 10–100 μm, containing up to 5% crystalline silica (Extendospheres TM SF-14) and silver-coated ceramic microspheres, 10–75 μm (Metalite TM Silver SF-20).

Another class of suitable ER active solid particles is that of polymeric salts, including silicone-based ionomers (e.g. the ionomer from amine functionalized diorganopolysiloxane plus acid), metal thiocyanate complexes with polymers such as polyethylene oxide, and carbon based ionomeric polymers including salts of ethylene/acrylic or methacrylic acid copolymers or phenol-formaldehyde polymers. Especially preferred is a polymer comprising an alkenyl substituted aromatic comonomer, a maleic acid comonomer or derivative thereof, and optionally additional comonomers, wherein the polymer contains acid functionality which is at least partly in the form of a salt. Preferably in such materials the maleic acid comonomer is a salt of maleic acid in which the maleic acid comonomer is treated with 0.5 to 2 equivalents of base. Most preferably this material is a 1:1 molar alternating copolymer of styrene and maleic acid, the maleic acid being partially in the form of the sodium salt. This material is described in more detail in PCT publication WO93/22409, Nov. 11, 1993.

Other materials which can be used as ER active solid particles include fused polycyclic aromatic hydrocarbons, phthalocyanine, flavanthrone, crown ethers and salts thereof, including the products of polymeric or monomeric oxygen- or sulfur-based crown ethers with quaternary amine compounds, lithium hydrazinium sulfate, and ferrites.

Certain of the above mentioned solid particles are customarily available in a form in which a certain amount of water or other liquid polar material is present. This is particularly true for polar organic particles such as cellulose or ionic polymers. These liquid polar materials need not necessarily be removed from the particles, but they are not generally required for the functioning of the present invention. The acceptable amounts of such liquid polar material is discussed in more detail below.

The particles used in the ER fluids of the present invention can be in the form of powders, fibers, spheres, rods, core-shell structures, etc. The size of the particles of the present invention is not particularly critical, but generally particles having a number average size of 0.25 to 100 μm, and preferably 1 to 20 μm, are suitable. The maximum size of the particles would depend in part on the dimensions of the electrorheological device in which they are intended to be used, i.e., the largest particles should normally be no larger than the gap between the electrode elements in the ER device. Since the final particles of this invention consist of the core particle plus a coating, the size of the core particle should be correspondingly somewhat smaller than the desired size of the final particle.

The core particles are coated with a layer of a metal carbonate, sulfate, thiosulfate, or sulfite. The carbonates, sulfites, and sulfates can be seen as salts of the acidic gases carbon dioxide, sulfur dioxide, or sulfur trioxide, respectively Thiosulfates can be prepared from sulfites by reaction with a source of sulfur, as described in greater detail below. Preferably the metal is an alkali metal, an alkaline earth metal, or aluminum, and most preferably it is calcium. The counter-ion of the metal is typically an anion derived from one of the aforementioned acidic gases. Carbon dioxide, for example, can be considered as an anhydride of carbonic acid, $H_2CO_3$, which is, in fact, the species which normally exists when carbon dioxide is dissolved in water. Corresponding materials will be found when carbon dioxide is dissolved in an alcoholic medium, formed by the reaction $$CO_2+ROH \rightarrow C(O)(OH)OR$$

Likewise sulfur dioxide can be considered an anhydride of sulfurous acid and sulfur trioxide an anhydride of sulfuric acid. Metal salts of carbon dioxide, for example, include metal carbonates and bicarbonates (hydrogen carbonates, representing the incomplete neutralization of carbonic acid). Preferably the salts are the metal carbonates, sulfites, and sulfates, respectively, representing substantially complete neutralization of the acids.

Of course, the metal salts need not be prepared by neutralization of the aqueous species. Calcium carbonate, the preferred coating, can be prepared, for example, by the reaction of calcium oxide or hydroxide with carbon dioxide in a non-aqueous medium:

$$CaO+CO_2 \rightarrow CaCO_3$$

$$Ca(OH)_2+CO_2 \rightarrow CaCO_3+H_2O$$

in which no water or alcohol or (preferably) a catalytic amount of water or alcohol is present.

The coating is applied by a process in which the metal salt is formed in situ as a coating on the core particles, by a process which includes reacting a metal oxide or a metal hydroxide with carbon dioxide, sulfur dioxide, or sulfur trioxide in the presence of the core particles. The coating and reaction is preferably effected by mixing the electrorheologically active particles and the metal oxide or hydroxide in a protic medium and supplying to the mixture one or more of the acidic gases in an amount to convert at least a portion of the metal oxide or hydroxide to the salt. The gas is normally added when the mixture is near room temperature or at an elevated temperature, i.e., 10° to 140° C., preferably 20°-100° and more preferably 30°-60° C. The lower limit of the temperature is not rigidly determined but practically will be a temperature below which the reaction becomes undesirably slow. The upper limit of the temperature will be determined by practical factors such as the solubility of the gas in the protic medium and the boiling point of the medium. Introduction of the acidic gas can be by any convenient means; preferably the gas is introduced by bubbling beneath the surface of the medium. The rate of introduction of the gas is not particularly critical and can be adjusted as desired to minimize reaction time and avoid undue bypass of unreacted gas. It is also possible that a liquid equivalent of the acidic gas can be employed with suitable modifications in equipment and procedure. For example, concentrated sulfuric acid or fuming sulfuric acid could be considered a source of $SO_3$.

Protic media are liquids which have labile protons. These commonly include water, alcohols, diols, polyols, alkoxyalcohols, and amines, and can also include phenols, and certain acids such as carboxylic acids. Acids can be suitable for use as the protic medium if the acid is used in a small (catalytic) amount and/or if is a weaker acid than is the acidic gas. The protic medium is believed to serve to provide solubility for the base, to facilitate its reaction with the gas. The protic medium can also contain non-protic components such as hydrocarbon solvents or oils, as long as there is a sufficient amount of a protic material, such as those named above, to facilitate contact of the reactive species. Preferably the medium contains at least 5% of the protic material, more preferably at least 20%, and most preferably at least 40%.

Preferably the protic medium is an alcoholic medium, that is, a predominantly alcohol liquid, which may contain other materials such as water or non-alcoholic organic solvents. Preferably the medium comprises alcohols which can be removed by evaporation or filtration, including propanol, isopropanol, n-butanol, i-butanol, t-butanol, pentanols, hexanols, 2-ethylhexanol, ocatanols, decanol, and dodecanol, or diols and polyols such as ethylene glycol, propylene glycol, and glycerol. Preferably the alcohol is methanol, ethanol, methoxyethanol, or mixtures thereof.

Metal thiosulfate coated particles can be prepared by reacting sulfite coated particles with a source of sulfur. The temperature of reaction is generally from about room temperature up to the decomposition temperature of the individual reactants or the reaction mixture. Typically, the reaction temperature is from 20° C. or 30° C. up to 300° C., 200° C., or 150° C. Typically from 0.1, 0.3, or 0.5 up to 10, 5, or 1.5 equivalents of sulfur is reacted with each equivalent of sulfur present in the metal sulfite. Preferably about 1 equivalent sulfur is reacted.

The sulfur source can be any of a variety of materials which are capable of supplying sulfur to the reaction. Examples of useful sulfur sources include elemental sulfur, which is sometimes preferred, sulfur halides, combinations of sulfur or sulfur oxides with hydrogen sulfide, and various sulfur-containing organic compounds. The sulfur halides include sulfur monochloride and sulfur dichloride. The sulfur-containing organic compounds include aromatic and alkyl sulfides, dialkenyl sulfides, sulfurized olefins, sulfurized oils, sulfurized fatty acid esters, sulfurized aliphatic esters of olefinic mono- or dicarboxylic acids, diester sulfides, sulfurized Diels-Alder adducts, and sulfurized terpenes.

The ER fluid may also contain other typical additives. Dispersants are often desirable to aid in the dispersion of the particles and to minimize or prevent their settling during periods of non-use. Such dispersants are known and can be designed to complement the properties of the hydrophobic fluid. For example, functionalized silicone dispersants or surfactants may be the most suitable for use in a silicone fluid, while hydroxyl-containing hydrocarbon-based dispersants or surfactants may be the most suitable for use in a hydrocarbon fluid. Functionalized silicone dispersants are described in detail in PCT publication WO93/14180, published Jul. 22, 1993 and include e.g. hydroxypropyl silicones, aminopropyl silicones, mercaptopropyl silicones, and silicone quaternary acetates. Other dispersants include acidic dispersants, ethyoxylated nonylphenol, sorbitan monooleate, basic dispersants, sorbitan sesquioleate, ethoxylated coco amide, oleic acid, t-dodecyl mercaptan, modified polyester dispersants, ester, amide, or mixed ester-amide dispersants based on polyisobutenyl succinic anhydride, dispersants based on polyisobutyl phenol, ABA type block copolymer nonionic dispersants, acrylic graft copolymers, octylphenoxypolyethoxyethanol, nonylphenoxypolyethoxyethanol, alkyl aryl ethers, alkyl aryl polyethers, amine polyglycol condensates, modified polyethoxy adducts, modified terminated alkyl aryl ethers, modified polyethoxylated straight chain alcohols, terminated ethoxylates of linear primary alcohols, high molecular weight tertiary amines such as 1-hydroxyethyl-2-alkyl imidazolines, oxazolines, perfluoralkyl sulfonates, sorbitan fatty acid esters, polyethylene glycol esters, aliphatic and aromatic phosphate esters, alkyl and aryl sulfonic acids and salts, and tertiary amines.

The composition of the present invention can further contain other additives and ingredient which are customarily used in such fluids. Most importantly, it can contain a polar activating material other than the aforementioned components.

As has been mentioned above, certain of the ER-active particles, such as cellulose or polymeric salts, commonly have a certain amount of water associated with them. This water can be considered such a polar activating material. The amount of water present in the compositions of the present invention is typically 0.1 to 30 percent by weight, based on the solid particles. More generally the amount of polar activating material (which need not be water) will be 0.1 to 10 percent by weight, based on the entire fluid composition, preferably 0.5 to 4%, and most preferably 1.5 to 3.5 weight percent, based on the fluid. The polar activating material can be introduced to the ER fluid as a component of the solid particles (such as absorbed water), or it can be separately added to the fluid upon mixing of the components. Whether the polar activating material remains dispersed through the bulk of the ER fluid or associates with the solid particles is not precisely known in every case, but such details are not essential to the functioning of the present invention. Indeed, even the presence of a polar activating material is not essential to the functioning of the fluids of the present invention or to the dispersant characteristics of the surfactant. Rather it is simply observed that some ER fluid systems function more efficiently when the polar activating material is present. Accordingly, it is sometimes desirable not to dry cellulose thoroughly before it is used in the ER fluids of the present invention, so that a certain amount of residual water can serve as an activating material. On the other hand, for fluids which will be exposed to elevated temperatures during their lifetime, it is often desirable that no water or other volatile material be present. Moreover, it may be undesirable to have significant amounts of water present if the coating material will interact unfavorably with the water, e.g. by dissolving. For such applications the use of an alternative polar material, having significantly lower volatility and reduced affinity for the coating material, can be useful.

Suitable polar activating materials include water, other hydroxy-containing materials as alcohols and polyols, including ethylene glycol, glycerol, 1,3-propanediol, 1,4-butanediol, 1,5-pentanediol, 2,5-hexanediol, 2-ethoxyethanol, 2-(2-ethoxyethoxy)ethanol, 2-(2-butoxyethoxy)ethanol, 2-(2-methoxyethoxy)ethanol, 2-methoxyethanol, 2-(2-hexyloxyethoxy)ethanol, and glycerol monooleate, as well as amines such as ethanolamine and ethylenediamine. Other suitable materials are carboxylic acids such as formic acid and trichloroacetic acid. Also included are such aprotic polar materials as dimethylformamide, dimethylsulfoxide, propionitrile, nitroethane, ethylene carbonate, propylene carbonate, pentanedione, furfuraldehyde, sulfolane, diethyl phthalate, and the like.

While the polar material is believed to be normally physically adsorbed or absorbed by the solid ER-active core particles, it is also possible to chemically react at least a portion of the polar material with the core polymer. This can be done, for example, by condensation of alcohol or amine functionality of certain polar materials with an acid or anhydride functionality on the polymer or its precursor. Such treatment would normally be effected before the coating material is applied to the core particles.

The amount of the electrorheologically active coated particles in the ER fluid should be sufficient to provide a useful electrorheological effect at reasonable applied electric fields. However, the amount of particles should not be so high as to make the fluid too viscous for handling in the absence of an applied field. These limits will vary with the application at hand: an electrorheologically active grease, for instance, would desirably have a higher viscosity in the absence of an electric field than would a fluid designed for use in e.g. a valve or clutch. Furthermore, the amount of particles in the fluid may be limited by the degree of electrical conductivity which can be tolerated by a particular device, since the particles normally impart at least a slight degree of conductivity to the total composition. For most practical applications the polymeric particles will comprise 5 to 60 percent by weight of the ER fluid, preferably 10 to 50 percent by weight, and most preferably 15 to 35 percent by weight. Of course if the nonconductive hydrophobic fluid is a particularly dense material such as carbon tetrachloride or certain chlorofluorocarbons, or if the particles themselves are particularly dense materials, these weight percentages could be adjusted to take into account the density. Determination of such an adjustment would be within the abilities of one skilled in the art.

Within the particle component, the relative amounts of the core electrorheologically active particles and the coating material should normally be such that the coating is effective to reduce the bulk conductivity of the core particles. This minimum amount of coating may or may not be sufficient to completely coat the core particles. That is, core particles may have coating on only a portion of their surface and still show useful improvements in properties. It is also possible that portions of the coating material can be independently present along with the core particles as separate particles, rather than strictly as a coating. It is preferred, however, that at least a substantial portion of the coating material actually be present as a coating on the core particles. It is preferred that the relative amounts of the core electrorheologically active particles and the coating material are be such that the coating material comprises 1 to 40 percent by weight of the total particle component. Preferably the coating material will comprise 2 to 30 percent of the particles, and more preferably 3 to 20%. At lower amounts of coating the reduction (improvement) in conductivity of the electrorheological fluid is less pronounced, while with higher amounts there is little additional advantage observed, and indeed the electrorheological activity can be reduced somewhat as the proportion of the particle comprising the active core is reduced.

The amount of the optional dispersant component in the present invention is an amount sufficient to improve the dispersive stability of the composition. Normally the effective amount will be 0.1 to 20 percent by weight of the fluid, preferably 0.4 to 10 percent by weight of the fluid, and most preferably 1 to 5 percent by weight of the fluid.

The electrorheological fluids of the present invention can be prepared by admixing the above-described components in appropriate concentrations. Such mixing should preferably be of sufficient thoroughness to provide a well-dispersed mixture of particles in the inert fluid. This mixing can be accomplished by any of a variety of well-known methods, including the ball milling, stirring or shaking by hand, shaking with a mechanical shaker, using a dispersator, a Waring TM blender, or an attritor, or by ultrasonic mixing. The method used will depend on the nature of the particle. Certain metal-coated microspheres, for instance, are very fragile and are preferably admixed by stirring or shaking of the fluid. Blending will be conducted for a period of time sufficient to achieve the desired degree of uniformity, which may require several hours, depending on the equipment selected.

The ER fluids of the present invention find use in clutches, valves, dampers, positioning equipment, and the like, where it is desirable to vary the apparent viscosity of the fluid in response to an external signal. Such devices can be used, for example, to provide an automotive shock absorber which can be rapidly adjusted to meet the road conditions encountered during driving.

EXAMPLES

Example 1

Silver-coated microspheres, 50 g, obtained from PQ Corporation and designated as Metalite TM Silver SF-20, 5 g calcium oxide, 200 g ethanol (containing a small amount of methanol and water), and 0.6 g water are placed in a 1 L round bottom flask equipped with a mechanical stirrer, a fritted subsurface gas dispersion tube, and a condenser. The mixture is stirred and heated to 45° C. Carbon dioxide gas is added through the dispersion tube at a rate of 5.7 standard L per hour (0.2 scfh) for 1 hour, 9.9 L/hr (0.35 scfh) for an additional 20 minutes, and 20 L/hr (0.7 scfh) for 15 minutes. The mixture is vacuum filtered hot to isolate the resulting solid. The solid (having a nominal coating of 10%) is dried in a steam chest for 24 hours, then dried at 100° C. under vacuum for 12 hours.

Electrorheological fluids are prepared by blending 20–30 weight percent of the dried solids with:

(a) silicone oil (5 or 10 cSt) along with 3% by weight EXP-69 TM hydroxy-functionalized silicone; and separately with (b) poly α-olefin oil (Emery TM 3004).

Example 2

Example 1 is substantially repeated but on a 4-fold larger scale.

Example 3

Example 1 is substantially repeated except that a corresponding amount of calcium hydroxide is used in place of calcium oxide, and no water is added (other than the water present in the ethanol).

Example 4

Example 1 is substantially repeated using 200.8 g of the silver-coated microspheres, 41.2 g calcium oxide, 800 g ethanol, and 2.4 g water, in a 2 L flask. Flow of carbon dioxide is 14 L/hr (0.5 scfh) for 4 hours followed by 7.1 L/hr (0.25 scfh) for 12 hours. The nominal coating is 20%.

Electrorheological fluids (a) and (b) are prepared as in Ex. 1.

Example 5

The following materials are combined in the 1 L flask of Example 1: 59.8 g polyaniline (prepared according to the procedure of PCT publication WO93/07244), 6.0 g calcium oxide, 241 g ethanol, and 1.1 g water. The mixture is heated with stirring to 45° C. Carbon dioxide is added at 14 L/hr (0.5 scfh) for 3 hours, then 7.1 L/hr (0.25 scfh) for 12 hours. The resulting black solid (with a nominal coating of 20%) is isolated by filtration and dried in a steam chest for 36 hours, then under vacuum at 150° C. for 12 hours.

Electrorheological fluids (a) and (b) are prepared as in Ex. 1.

Example 6

The following materials are combined in the 2 L flask of Example 2: 35 g of a polymer of aniline (1 mole) and o-toluidine (1 mole), prepared according to the general procedure of PCT publication WO93/07244, is further treated with $SO_3$. A flask containing the polymer and a hydrocarbon medium is charged with sulfur trioxide (1.1 moles per 0.92 equivalents polymer). During the course of the addition of the sulfur trioxide (about 4 hours) the mixture is maintained at about 40° C. The sulfur trioxide is added along with a nitrogen stream (40 L/hr, 1.4 scfh). The resulting solid is isolated by filtration and washing with distilled water, drying in a steam chest, sieving, and further drying under vacuum. The solids are again washed with water and ammonium hydroxide for several hours, filtered, and again washed with water, isolated by filtration, and again subjected to drying in a steam chest (48 hours), sieving, and drying at 150° C. under dynamic vacuum (12 hours).

The material so prepared is combined with 1.75 g calcium oxide, 800 g ethanol, and 1.25 g water. The mixture is heated with stirring to 45° C. Carbon dioxide is added at 7.1 L/hr (0.25 scfh). The mixture is cooled to 40° C. and an additional 20 g polymer and 1.0 g calcium oxide are added. Carbon dioxide is added at 10 L/hr (0.35 scfh) for 12 hours, at 40° C. A black solid (having a nominal coating of 5%) is isolated as in Example 3.

An electrorheological fluid is prepared by blending 20 weight percent of the dried solids with 10 cSt silicone.

Example 7

Example 1 is substantially repeated except that the silver-coated microspheres are replaced by a comparable amount of hollow silica microspheres (Extendospheres TM SF-14 from PQ Corporation). The amount of water used is 2.7 g; $CO_2$ is added to the mixture over a period of about 16 hours. (Nominal coating of 10%)

An electrorheological fluid is prepared by blending 20% of the solids so prepared with 80% Emery 3004 poly alpha olefin oil.

Example 8

Example 7 is substantially repeated using 500 g of the SF-14 microspheres, 100 g CaO, 2000 g ethanol, and 2 g water. The $CO_2$ is supplied at 3.0 scfh for about 12 hours at 45° C. with stirring. The mixture thus prepared is divided into two 4 L (1 gal.) jars. To each jar is added 2 L water. The coated microspheres are less dense than water and are separated thereby from bulk $CaCO_3$, which is more dense than water.

An electrorheological fluid is prepared using 30% by weight of the solids so prepared (nominal coating 20%), with 70% Emery TM 3004 poly alpha olefin oil.

Example 9

Example 5 is substantially repeated except that the polyaniline is a commercially available material, Versicon TM, from Allied Signal which is washed with 310 g ammonium hydroxide and dried at 150° C. under dynamic vacuum prior to use. The amount of polyaniline is 50.4 g and the amount of calcium oxide is 2.51 g, for a nominal coating of 5%.

An electrorheological fluid is prepared by mixing 20% by weight of the particles in 10 cSt silicone oil with 3% EXP-69 functional silicone surfactant.

Example 10

Example 9 is substantially repeated except that the amount of calcium oxide is 5 g, for a nominal coating of 10%.

Example 11

Example 9 is substantially repeated except that the amount of polyaniline is 40.1 g and the amount of calcium oxide is 8.2 g, for a nominal coating of 20%.

Example 12

Example 5 is substantially repeated except using 50 g cellulose CC-31 from Whatman in place of the polyaniline, 2.5 g calcium oxide (for a nominal coating of 5%), 200 g ethanol, and 0.6 g water. Carbon dioxide is added over a period of about 6 hours. The resulting coated particles are compounded into an electrorheological fluid of 30 percent by weight solid particles, in silicone oil, with 3% EXP-69 functional silicone surfactant and 1% ethylene glycol polar additive.

Example 13

Example 3 is substantially repeated except that the carbon dioxide gas is replaced by sulfur dioxide gas.

Certain of the fluids prepared above are tested to measure current density (in $mA/m^2$) and shear stress (in kPa at 20,000 $sec^{-1}$ shear rate) at 6 kV/mm electric field. The fluids are tested in an oscillating duct flow device. This device pumps the fluid back and forth through parallel plate electrodes. The shear stress is determined by measuring the force required to move the fluid through the electrodes. The mechanical amplitude is ±1 mm and the electrode gap is 1 mm. The mechanical frequency range is 0.5 to 30 Hz, which produces a shear rate range of 600 to 36,000 $sec^{-1}$. The shear rate is calculated at the wall of the electrodes assuming Poiseuille flow. This device is described in greater detail in PCT publication WO93/22409, published Nov. 11, 1993.

The results are reported in Table I.

TABLE I

| Fluid from Example: | % Coat | Temp. °C. | Shear Stress kPa | Current Density $mA/m^2$ |
|---|---|---|---|---|
| 1(b) (30% solids) | 10 | 20 | 1.83 | 653.3 |
| | | 80 | 0.79 | 645.1 |
| 4(b) (30% solids) | 20 | 20 | 2.13 | 699.8 |
| | | 80 | 1.01 | 739.2 |
| Ag-coated microspheres of Ex 1, w/o salt coating (reference) | 0 | | too conductive to test | |
| 5(a) (20% solids) | 20 | 20 | 3.4 | 19.41 |
| | | 80 | 1.91 | 31.85 |
| Polymer of Ex. 5(a) w/o coating (20%) (reference) | 0 | 20 | 4.78 | 41.42 |
| | | 80 | 2.53 | 203.5 |
| 6(b) (30% solids) | 5 | 20 | 1.7 | 27 |
| | | 80 | 1.2 | 60 |
| Polymer of Ex. 6(b) w/o coating (30%) (reference) | 0 | 20 | 1.8 | 85 |
| | | 80 | 1.9 | 900 |

TABLE I-continued

| Fluid from Example: | % Coat | Temp. °C. | Shear Stress kPa | Current Density mA/m$^2$ |
|---|---|---|---|---|
| 8(b) (30% solids)[a] | 20 | 20 | 2.26 | 5.26 |
| | | 80 | 1.54 | 4.21 |
| Microspheres of Ex. 8(b) w/o coating (30%) (reference) | 0 | 20 | 1.45 | 5.7 |
| | | 80 | 0.92 | 23.7 |
| 9(a) (20% solids) | 5 | 20 | 2.41 | 317.4 |
| 10(a) (20% solids) | 10 | 20 | 2.21 | 180.1 |
| 11(a) (20% solids) | 20 | 20 | 2.39 | 221.1 |
| Polymer of Ex. 9-11(a) w/o coating (20%) (reference) | 0 | 20 | 1.85 | 213.6 |
| 12 (a) (30% solids) | 5 | 20 | 2.52 | 2.07 |
| | | 40 | 2.37 | 2.13 |
| | | 50 | 3.02 | 3.53 |
| | | 60 | 3.40 | 6.16 |
| | | 80 | 3.56 | 12.98 |

[a]A corresponding test of the material of Ex. 7 exhibited a shear stress of 1.53 at 20° C., but a current density of 567 mA/m$^2$. It is believed that this value is in error.

The results show that electrorheological fluids prepared using the particles of the present invention generally exhibit reduced conductivity or improved shear stress, particularly at high temperatures.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

What is claimed is:

1. An electrorheological fluid comprising a hydrophobic liquid phase and, dispersed therein, electrorheologically active particles comprising a core particle and a coating of; calcium carbonate.

2. The electrorheological fluid of claim 1 wherein the core particle is conductive or semiconductive.

3. The electrorheological fluid of claim 2 wherein the core particle is capable of exhibiting electrorheological activity when substantially anhydrous.

4. The electrorheological fluid of claim 1 wherein the core particle is a polymeric material.

5. The electrorheological fluid of claim 4 wherein the polymeric material is an aniline homopolymer or copolymer.

6. The electrorheological fluid of claim 1 wherein the core particle is cellulose.

7. The electrorheological fluid of claim 1 wherein the core particle is an inorganic material.

8. The electrorheological fluid of claim 7 wherein the inorganic material is silica.

9. The electrorheological fluid of claim 1 wherein the metal salt coating is prepared by steps which include reacting; calcium oxide or calcium hydroxide with carbon dioxide, in the presence of the core particles.

10. The electrorheological fluid of claim 1 wherein the amount of particles in the fluid is about 5 to about 60 percent by weight of the fluid.

11. The electrorheological fluid of claim 1 wherein the particles have a number average size of about 0.25 to about 100 micrometers.

12. The electrorheological fluid of claim 1 further comprising a dispersing agent in an amount sufficient to improve the dispersion of the particles.

13. The electrorheological fluid of claim 12 wherein the dispersing agent is a functionalized silicone.

14. The electrorheological fluid of claim 1 wherein the hydrophobic liquid phase is selected from the group consisting of silicone oils, transformer oils, mineral oils, vegetable oils, aromatic oils, paraffin hydrocarbons, naphthalene hydrocarbons, olefin hydrocarbons, chlorinated paraffins, synthetic esters, hydrogenated olefin oligomers, and mixtures thereof.

15. The electrorheological fluid of claim 14 wherein the hydrophobic liquid phase is a silicone oil.

16. A clutch, valve, shock absorber, or damper containing the electrorheological fluid of claim 1.

17. The electrorheological fluid of claim 1 wherein the coating is substantially insoluble in water.

* * * * *